US005303848A

United States Patent [19]

D'Andrade

[11] Patent Number: 5,303,848

[45] Date of Patent: Apr. 19, 1994

[54] DOUBLE POSITION BAYONET CONNECTION FOR PRESSURE TANK

[76] Inventor: Bruce M. D'Andrade, 3 Ten Eyck Rd., Whitehouse Station, N.J. 08889

[21] Appl. No.: 82,734

[22] Filed: Jun. 28, 1993

[51] Int. Cl.[5] ..... A63H 3/18

[52] U.S. Cl. ..... 222/79; 222/400.8; 222/401; 222/397; 42/54; 273/349; 446/473

[58] Field of Search ..... 222/79, 400.8, 401, 222/396-399, 325, 181, 185, 400.7; 273/349; 124/70, 73; 42/54; 446/473

[56] References Cited

U.S. PATENT DOCUMENTS

| | | | |
|---|---|---|---|
| 3,091,372 | 5/1963 | Tidd | 222/401 |
| 3,197,070 | 7/1965 | Pearl et al. . | |
| 3,578,789 | 5/1971 | Ferri . | |
| 4,214,674 | 7/1980 | Jones et al. . | |
| 4,239,129 | 12/1980 | Esposito . | |
| 4,291,821 | 9/1981 | Nezworski | 222/400.7 X |
| 4,350,273 | 9/1982 | Nezworski et al. | 222/400.7 X |
| 4,363,336 | 12/1982 | Cerrato | 222/400.7 |
| 4,538,746 | 9/1985 | Hines | 222/400.7 X |
| 4,728,010 | 3/1988 | Johnston | 222/397 |
| 4,735,239 | 4/1988 | Salmon et al. . | |
| 4,854,480 | 8/1989 | Shindo . | |
| 4,982,876 | 1/1991 | Scott | 222/400.7 X |
| 5,074,437 | 12/1991 | D'Andrade et al. . | |
| 5,150,819 | 9/1992 | Johnson et al. . | |
| 5,184,755 | 2/1993 | Brovelli | 222/396 X |

*Primary Examiner*—Andres Kashnikow
*Assistant Examiner*—Kenneth DeRosa
*Attorney, Agent, or Firm*—Kenneth P. Glynn

[57] ABSTRACT

The present invention involves a water gun having a housing, a barrel, at least one removable pressurizable air/water storage tank, means for connecting the tank(s) to the housing of the gun, a pressurizing mechanism, a channel of release for shooting water and a water release mechanism. The improvement lies in the particular connecting member for connecting the tank(s) to the housing of the water gun. The connecting member is a double position bayonet connection between the tank and the housing. It includes a female, receiving collar with a circular channel about its inside and a male protrusion collar. The channel has a top flange over it and has a drop in for cut outs for insertion of a male protrusion counterpart. The channel has a first predetermined depth along at least a first arc under the flange and has a second deeper locking predetermined depth along at least a second arc under the flange. The arcs include a pressure release opening through the sidewall so as to eliminate pressurization of the tank and the second arc specifically includes sealing member to permit pressurization of the tank.

20 Claims, 3 Drawing Sheets

DOUBLE POSITION BAYONET CONNECTION FOR PRESSURE TANK

BACKGROUND OF THE INVENTION

1. Field of the Invention

The present invention is directed toward a toy water squirt gun, and more particularly to such toy water squirt guns that use a self-contained pumping means to pressurize air in an air/water tank. The water is then released in a selective manner, e.g. through a nozzle, causing the stored water to be propelled forward in a narrow stream. Specifically, the present invention involves a double position bayonet type connector for connecting pressurizable tanks to water guns.

2. Information Disclosure Statement

Water guns have for decades been a very popular child's toy. Since the toy industry is very competitive, hundreds of different style water guns have been developed in an attempt to profit from the toys inherent popularity. The most traditional forms of water guns are activated by a pumping action, either manually through the trigger or automatically through a battery operated motor. Such pump action water guns work, but the guns are limited in the distance the water travelled, the amount of water projected and the duration of the pumping cycle. In an attempt to improve upon water guns the toy industry has developed pressure activated water guns. Such pressure water guns work upon the principle of pressure differentials between the water held within the toy and the atmosphere. The water within the toy is held at a pressure higher than that of the ambient air. As a result, when the water within the toy is given a channel of release, the water will stream out under the pressure. The present invention involves an improved release mechanism for such guns.

Prior art that shows pressure differential types of water guns are exemplified by the following:

U.S. Pat. No. 3,197,070 to Curtis F. Pearl et al, shows a water gun activated by trapping water in a collapsible area. As the device is collapsed, the pressure of the water builds, spraying the water out of the one small orifice left within the pressured volume. Once the confined volume is fully collapsed, the re-expansion of the volume draws forth more water from a reservoir, thus priming the water gun for another cycle. The water being pressurized is limited to the volume of the collapsible volume.

U.S. Pat. No. 4,854,480 to Robert S. Shindo and U.S. Pat. No. 4,735,239 to Michael E. Salmon et al, both show toy water devices that use an elastic bladder to pressurize water. The bladders are filled with high pressure water, and the bladders respond by elastically deforming. The source of pressurized water is then removed and the water within the expanded bladder is held in place by a clamping device activated by a trigger. The water gun is used by selectively releasing the water from the expanded bladder.

Water guns have also been developed that use air pressure to pressurize water and force water through squirt channels. Such toys that use air pumps to pressurize water are exemplified by the following:

U.S. Pat. No. 4,214,674 to Jones et al, shows a two-piece apparatus consisting of a pressurized water reservoir and a discharging gun. Air is introduced into the water reservoir via a hand operated pump. The air pressurizes the water, forcing it up through the discharging gun, where the rate of discharge can be regulated by a trigger.

U.S. Pat. No. 4,239,129 to Gary F. Esposito describes a water pistol and/or flashlight structure which includes a reciprocal pump within the gun housing. The pump is used to pressurize air within the tank after water has been added, and a trigger is used for subsequent release of the water. Battery operated lights and sound are also provided.

U.S. Pat. No. 3,578,789, issued to Giampiero Ferri, describes a water pistol which includes a main liquid reservoir and a pressurized liquid reservoir contained within the main liquid reservoir. A trigger-actuated pump is used with a manually operated three way valve to selectively supply liquid: (a) from the pump to the pressurized reservoir; (b) from the pump to the nozzle and to the pressurized liquid reservoir; or, (c) from the pump to both the pressurized liquid reservoir and nozzle.

U.S. Pat. Nos. 5,074,437 and 5,150,819 issued to Johnson and D'Andrade describe single tank and double tank pump up pressurized tank water guns which are commercially known as "Super Soakers" (trademark of Larami Corporation, Philadelphia Pa.) and have experienced substantial commercial success due to their ability to project streams of water over unusual distances and for extended time periods.

Notwithstanding the prior art, the present invention double position bayonet is neither taught nor rendered obvious.

SUMMARY OF THE INVENTION

The present invention involves a water gun having a housing, a barrel, at least one removable pressurizable air/water storage tank, means for connecting the tank(s) to the housing of the gun, a pressurizing mechanism, a channel of release for shooting water and a water release mechanism. The improvement lies in the particular means for connecting the tank(s) to the housing of the water gun. Disconnecting means is a double position bayonet connection between the tank and the housing. It includes a female, receiving collar with a circular channel about its inside. The channel has a top flange over it and has a drop-in for cut-outs for insertion of a male protrusion counterpart. The channel has a first predetermined depth along at least a first arc under the flange and has a second deeper locking predetermined depth along at least a second arc under the flange. The arcs include a pressure release opening through the sidewall so as to eliminate pressurization of the tank and the second arc specifically includes sealing means to permit pressurization of the tank. This sealing means may simply be its geometry so as to hold a male protrusion collar in place properly. The bayonet connection includes a male protrusion collar with an orifice up its center portion and a circular segment with male flanges. These male flanges are the same size or smaller than the drop-in cut-outs of the female receiving collar and are inserted therein. The male protrusion collar is rotated so that the flanges pass through the first arc and then to the second arc. When in the second arc position, these flanges render the connection between the tank and the housing of the water gun pressurizable. When the tank is removed by rotating the tank and its male protrusion collar out of the second arc and back into the first arc, the pressure release opening releases any excessive air pressure within the water gun and therefore eliminates pressure to the tank before the tank is rotated out of the second arc and lifted upwardly through the drop in cut outs of the female receiving collar.

BRIEF DESCRIPTION OF THE DRAWINGS

The invention will be more fully understood by referring to the following detailed specifications. The above specification and the claims set forth herein, when taken in connection with the drawings appended hereto provide the requisite details, wherein:

DETAILED DESCRIPTION OF THE PRESENT INVENTION

The present invention is, as mentioned, directed toward an improved toy water gun that uses a pump, to draw and pressurize water and air, storing the water and air under pressure until selectively discharged. The science of pressurized water toys is not new, and over the years many different designs have been developed utilizing a pumping action to pressurize water. As applied to the art of toy water squirt guns, the most common type of device involves a two-stroke pump, wherein the pump draws water into a chamber through a large orifice during the priming stroke, and forces water out of the chamber through a very narrow orifice during the compression stroke. This simple system forms the basis of thousands of devices in addition to water guns, such as non-aerosol dispensing devices for hair spray, perfume, window cleaner, and countless other products that are dispensed in a narrow stream or mist.

The problem with simple two-stroke squirting systems is that the amount of fluid that can be expelled is limited to a single volume of the compressible area; also, the pressure of the liquid exiting the device is dependent directly upon the force being applied during the time of expulsion. Consequently, when water is squirted in this manner, only a small volume is released with each pumping action. When attempts are made to increase the amount of water propelled by increasing the volume of the compressible area, the pumping action cannot displace the water at a high pressure, resulting in expulsion of water at low pressures.

Water guns need the characteristics of squirting a large volume of water at high pressures. The higher the pressure, the longer the distance the water can be propelled, thus increasing the range and power of the water gun. As a result, the invention herein, in conjunction with another inventor, developed pressured water guns as exemplified by U.S. Pat. No. 5,151,819, entitled "Double Tank Pinch Trigger Pump Water Gun", to Lonnie G. Johnson and Bruce M. D'Andrade on Sep. 29, 1992, incorporated herein by reference in its entirety, as well as U.S. Pat. No. 5,074,437, entitled "Pinch Trigger Pump Water Gun", to Bruce M. D'Andrade and Lonnie G. Johnson on Dec. 24, 1991, also incorporated herein by reference in its entirety.

The present invention release double position bayonet connection is advantageously used for any type of pressurized water gun with removable tanks, wherein force is created for release of water for shooting, and the present invention may be used with low pressure, medium pressure and high pressure water guns. Low pressure water guns are those which operate above ambient pressure but below 40 psi. Medium pressure water guns operate in the range of about 40 to 70 psi and high pressure water guns operate at pressures above 70 psi.

Figure 1:
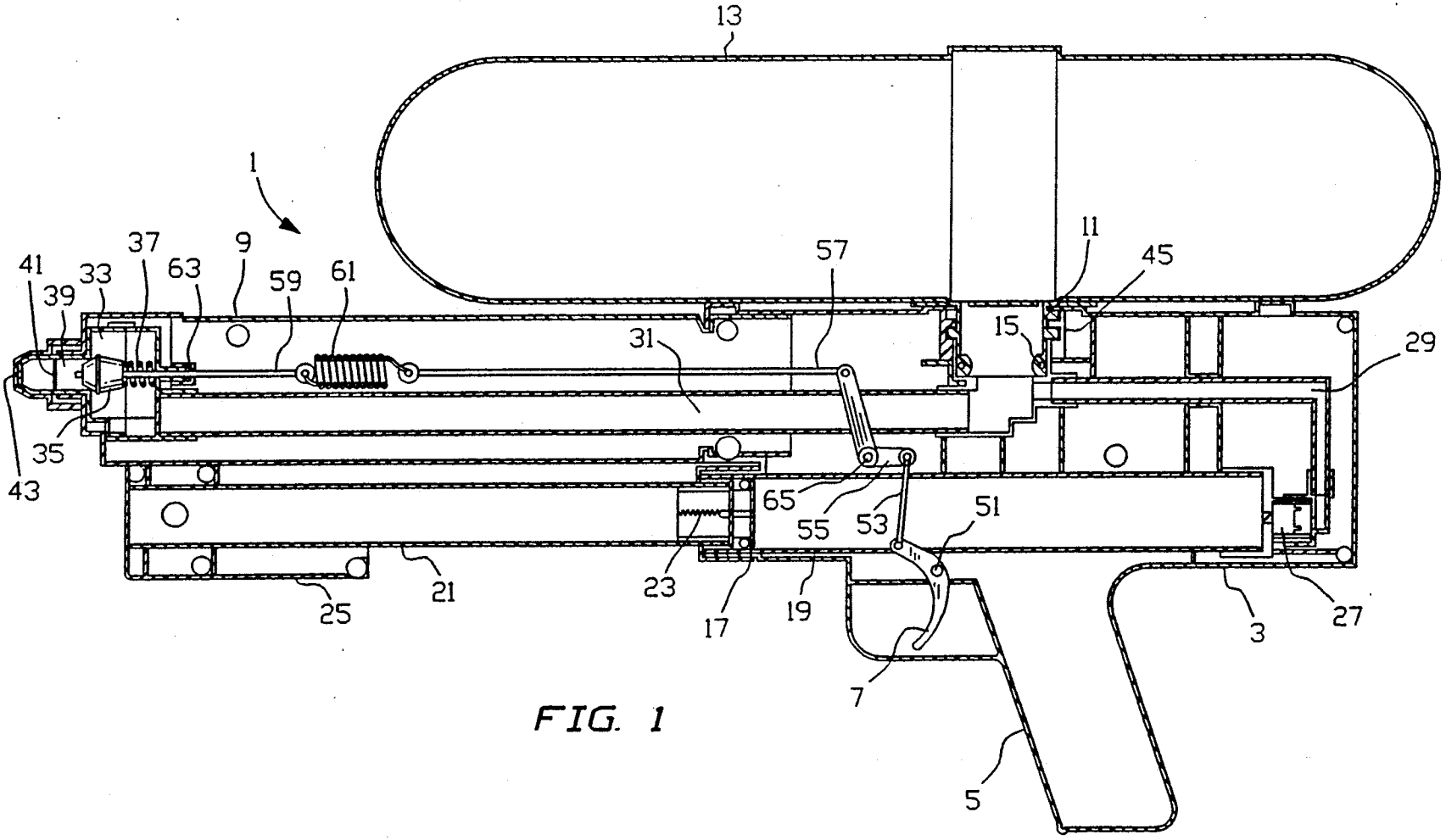
FIG. 1 shows a side cut view of one preferred embodiment of a water gun utilizing the double position bayonet connection of the present invention.

Referring now to FIG. 1 there is shown a present invention water gun 1 which includes housing 3. This main housing is shown with its essential components and, as is the entire figure, is illustrated in a side cut view. There is a handle 5 extending from housing 3 with a trigger 7. There is also an extending barrel 9 and an air/water pressurizable storage tank 13 with male protrusion bayonet attachment component 11. Thus, tank 13 is rotated and then lifted out in a bayonet type fashion, and more details of this will be apparent from the following discussion of subsequent drawings.

Male protrusion component 11 includes a ring seal 15 and is connected to female receiving collar 45. These collars make up the critical features of the present invention, and the connection utilizing these two collars has a double position before the male collar is removed from the female collar. Thus, there is an intermediate position which permits release of pressure for enhanced safety.

There is a pressurizing piston 17 which is attached to piston rod 21 and is located within chamber 19. Slider 25 is attached to piston rod 21 and in a movable fashion moves forward and rearward relative to extended barrel 9. There is a pressure release spring valve 23 which prevents overpressurization of the water gun. When slider handle 25 is reciprocated, air pressure builds up within the water gun until a predesired pressure is reached and then spring valve 23 will release excess pressure. One way valve 27 permits air to be forced into but not to be returned from chamber 19.

When tank 31 is removed from main housing 3 and partially filled with water, for example, half to three-quarters filled with water, it is then returned to main housing 3 by the user by inverting the water gun 1 and attaching the tank to the water gun. Then slider handle 25 is reciprocated and pressure is built up. Note that when the gun 1 is uprighted, the water from tank 13 will, at least in part, seek its lowest level through gravity and, therefore, fill up conduit 29, channel of release 31, including wider portion 33, as well as the open area within female receiving portion 45 of the connection. Thus air pressure will build up in the top of air/water pressurizable storage tank 13 and will put pressure on the water within gun 1.

Trigger 7 has a pivot attachment 51 and extends below main housing 3 so that it may be manually activated. Its inside portion is connected to linkage 53 which is likewise connected to arm 55 which has a pivot point 65. This is connected to linkage 57 which is connected also to linkage 59 via spring 61. This spring 61, a direct part of the linkage, has predetermined strength and extensions so that it operates to create a burst of flow. Linkage 59 is connected to plug valve 35 which seals off the channel of release to prevent water from leaving the water gun and first spring 37 biases plug valve 35 to its first, closed position. It has a second, opened position to the right of the drawing when first spring 37 is compressed. When a user has pressurized gun 1 with water contained therein, when trigger 7 is pulled, the linkage extends second spring 61 so that it extends to a predetermined length and, at that point, overcomes the strength of first spring 37 to rapidly move plug valve 35 from its first, closed position to its second, opened position, thereby allowing a burst of water to flow out of the gun. When trigger 7 is released, spring 37 again closes plug valve 35.

Although not required, in this embodiment, due to a large nozzle opening 43, e.g., ⅛ inch diameter, screen 41 is included in the front portion 39 of the channel of release beyond plug valve 35 so as to eliminate a substantial part of the turbulence and create laminar flow.

While FIG. 1 illustrates a preferred water gun embodiment, it is presented to illustrate the present invention but the present invention double position bayonet connection may be used with any water gun having removable, pressurizable tanks.

Figure 2:
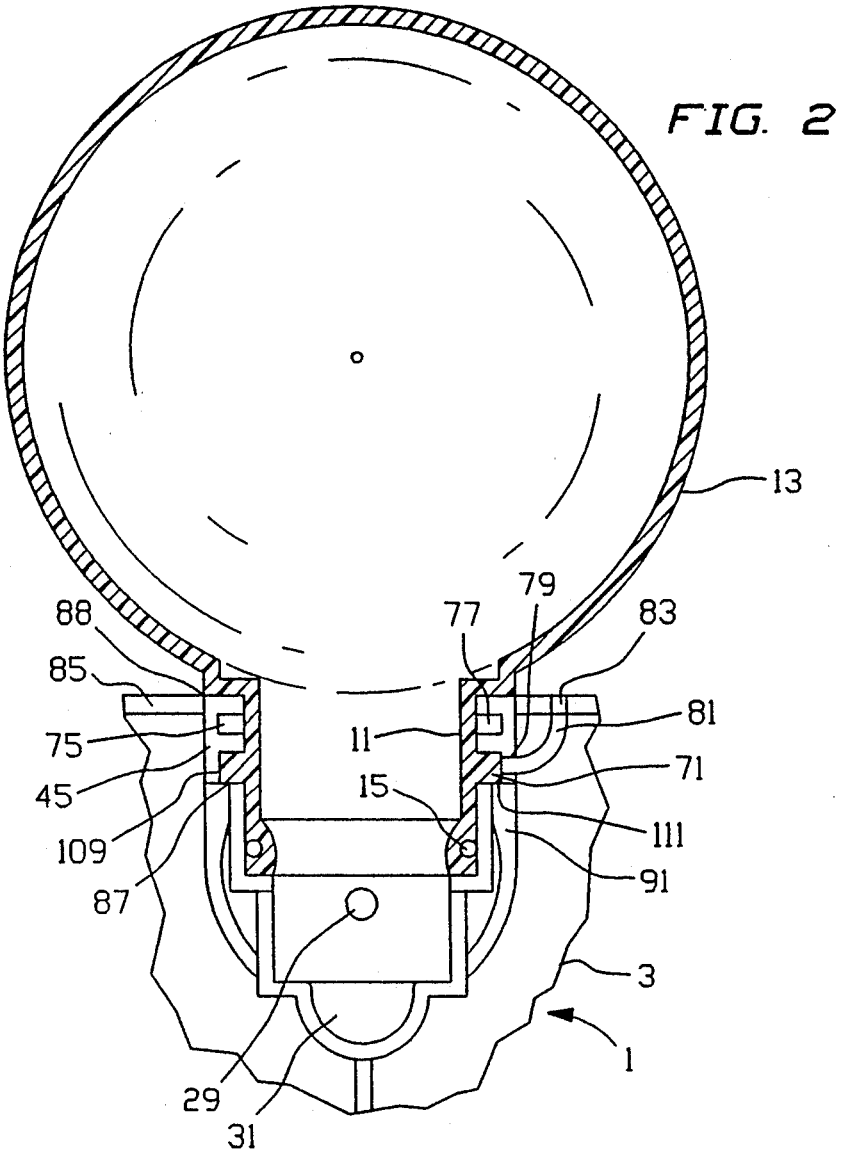
FIG. 2 shows a front cut view of a tank and part of the water gun housing shown in FIG. 1.

FIG. 2 shows a cut front view of the tank 13 of water gun 1 shown in FIG. 1 and shows a portion of housing 3 thereof. This view provides more detail of the double position bayonet of the present invention. Herein, pressurizable tank 13 includes a male protrusion collar 11 with two flanges protruding therefrom, designated as flanges 71 and 87. Main housing 3 includes the top wall 85 which contains a large opening 88 into which female receiving collar 45 has been permanently affixed (e.g. by glue, plastic welding or otherwise). Female receiving collar 45 includes channels 109 and 111 into which flanges 87 and 71 respectively are positioned and seated. O ring seal 15 is also included in male protrusion collar 11 and prevents leakage. In the position shown, tank 13 is connected to housing 3 in such a way so that it is pressurizable with minimal or no pressure leakage and has an open path to inlet tube 29 and channel of release 31. There is a section of housing 3 designated as member 91 upon which female receiving collar 45 rests and, therefore, a top of which flanges 87 and 71 rest. Female receiving collar 45 has an opening 79 with tubing 81 to opening 83 of housing wall 85 which, when tank 13 is rotated outwardly, exposes opening 79 and tube 81 to the internal pressures of the water gun and releases any pressure in excess of ambient pressure.

Figure 3:
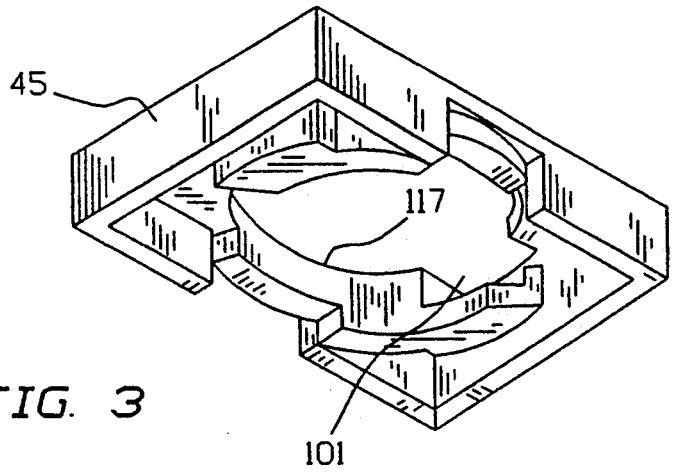
FIG. 3 shows a bottom oblique view of the female receiving collar of a present invention double position bayonet and FIG. 4 shows a flat unrolled cut view of the collar shown in FIG. 3
Figure 4:
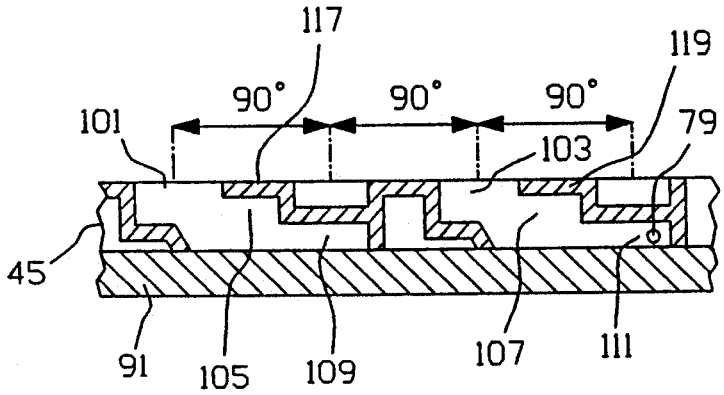
Figure 5:
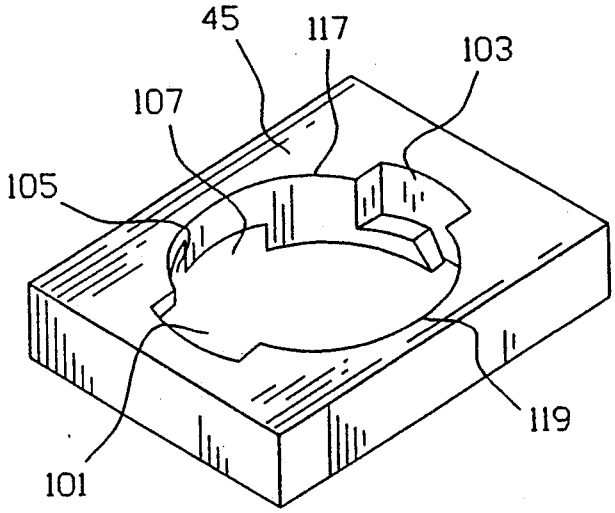
FIG. 5 shows a top perspective view of that collar; and, FIG. 6 shows an unrolled inside cut view of an alternative embodiment female receiving collar of the present invention.

FIG. 3 shows a bottom oblique view of female receiving collar 45 and, here, it can be seen that there are drop-in cut-outs 101 and 103 (FIG. 4). Referring now to FIGS. 3, 4 and 5 simultaneously, collar 45 has the cut-out drop-ins 101 and 103 as indicated as well as first arcs 105 and 107 and second arcs 109 and 111. FIG. 4 shows a flattened out cut inside view of these channels and also clearly shows flange portions 117 and 119.

It can now be seen that flanges 87 and 71 may be dropped into cut outs 101 and 103 and that, rotating tank 31 so that flanges 71 and 87 drop down into first arcs 105 and 107, that release orifice 79 is still exposed and would be exposed in that position when tank 13 is being removed. As tank 13 is rotated further and the flanges 71 and 87 move into second arcs 109 and 111, due to the tightness of the fit based on the height of the second arcs, the tank fits snugly and securely with a mild force fit and seals off pressure release openings 79 simultaneously.

Figure 6:
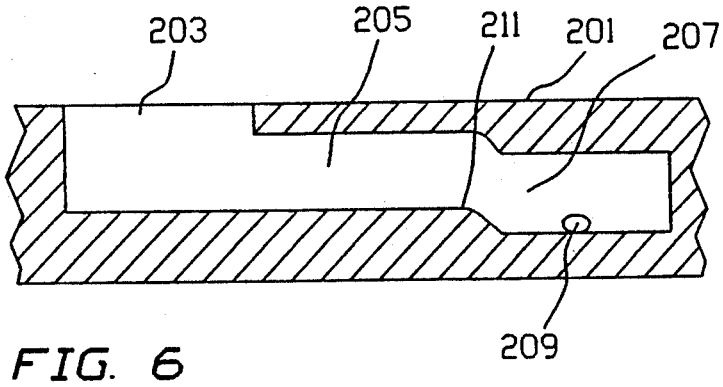

Referring now to FIG. 6, the results are shown a "rolled out" cut inside view of an alternative arrangement. Here, drop in cut out 203 is followed by a first arc 205, a bump 211 and a second arc 207 with pressure release opening 209. This female receiving collar 201 may include two or three or more such sections of drop in cut outs, first arcs and second arcs to correspond to an identical number of flanges on a corresponding male protrusion collar to affect the double position bayonet connection of the present invention.

Obviously, numerous modifications and variations of the present invention are possible in light of the above teachings. It is therefore understood that within the scope of the appended claims, the invention may be practiced otherwise than as specifically described herein.

What is claimed is:

1. In a water gun having a housing, a barrel, at least one removable pressurizable air/water tank with a discharge orifice, a pressurizing mechanism, a channel of release for shooting water, and a release mechanism, the improvement which comprises:

a double position bayonet connection between said tank and housing, including:

a) a female, receiving collar, having a sidewall with an inside and an outside, an orifice surrounded by said sidewall and a circular channel about the inside of said sidewall, said channel having a top flange thereover, said top flange having drop-in cut-outs for insertion of a male protrusion counterpart, and said channel having a first predetermined depth along at least a first arc under said flange, and having a second, deeper, locking, predetermined depth along at least a second arc under said flange, whereby said female receiving collar includes a pressure release opening through said sidewall so as to eliminate pressurization of said tank, and said second arc includes a sealing means to permit pressurization of said tank; and, b) a male protrusion collar, having an orifice and a circular segment with male flanges, said male flanges being the same size or smaller than the drop-in cut-outs of said female receiving collar and adapted to insert into said receiving collar so as to be rotatable with said male flanges tracking said first arc and then said second arc to removably interlock therewith and to seal said tank to said housing to permit pressurization of said tank;

further wherein one of said female receiving collar and said male protrusion collar is located on said discharge orifice of said tank, and the other of said female receiving collar and said male protrusion collar is located on said housing.

2. The water gun of claim 1 wherein said female receiving collar includes a set of two first arcs and a set of two second arcs and said male protrusion collar includes two male flanges.

3. The water gun of claim 2 wherein said two first arcs are opposite one another and two second arcs are opposite one another.

4. The water gun of claim 1 wherein the combined angle formed by said first arc and said second arc does not exceed 100 degrees.

5. The water of claim 2 wherein the combined angle formed by said first arc and said second arc does not exceed 100 degrees.

6. The water gun of claim 3 wherein the combined angle formed by said first arc and said second arc does not exceed 100 degrees.

7. The water gun of claim 1 wherein the angle formed by said first arc is between 30 degrees and 50 degrees and the angle formed by said second arc is between 30 degrees and 50 degrees.

8. The water gun of claim 2 wherein the angle formed by said first arc is between 30 degrees and 50 degrees and the angle formed by said second arc is between 30 degrees and 50 degrees.

9. The water gun of claim 3 wherein the angle formed by said first arc is between 30 degrees and 50 degrees and the angle formed by said second arc is between 30 degrees and 50 degrees.

10. The water gun of claim 1 wherein said male protrusion collar is located on said tank and said female receiving collar is located on said housing.

11. In a water gun having a housing, a barrel, at least one removable pressurizable air/water tank with a discharge orifice, a pressurizing mechanism, a channel of release for shooting water, and a release mechanism, the improvement which comprises:

a double position bayonet connection between said tank and housing, including:

a) a female, receiving collar, having a sidewall with an inside and an outside, an orifice surrounded by said sidewall and a circular channel about the inside of said sidewall, said channel having a top flange thereover, said top flange having drop-in cut-outs for insertion of a male protrusion counterpart, and said channel having at least a first arc of a predetermined angle under said flange, and having at least a second arc of a predetermined angle under said flange, whereby said first arc includes a pressure release opening through said sidewall so as to eliminate pressurization of said tank, and said second arc includes a sealing means to permit pressurization of said tank; and, b) a male protrusion collar, having an orifice and a circular segment with male flanges, said male flanges being the same size or smaller than the drop-in cut-outs of said female receiving collar and adapted to insert into said receiving collar so as to be rotatable with said male flanges tracking said first arc and then said second arc to removably interlock therewith and to seal said tank to said housing to permit pressurization of said tank;

further wherein one of said female receiving collar and said male protrusion collar is located on said discharge orifice of said tank, and the other of said female receiving collar and said male protrusion collar is located on said housing.

12. The water gun of claim 11 wherein said female receiving collar includes a set of two first arcs and a set of two second arcs and said male protrusion collar includes two male flanges.

13. The water gun of claim 12 wherein said two first arcs are opposite one another and two second arcs are opposite one another.

14. The water gun of claim 11 wherein the combined angle formed by said first arc and said second arc does not exceed 100 degrees.

15. The water gun of claim 11 wherein a stop bump is located between said first arc and second arc.

16. The water gun of claim 12 wherein a stop bump is located between said first arc and second arc.

17. The water gun of claim 11 wherein the angle formed by said first arc is between 30 degrees and 50 degrees and the angle formed by said second arc is between 30 degrees and 50 degrees.

18. The water gun of claim 12 wherein the angle formed by said first arc is between 30 degrees and 50 degrees and the angle formed by said second arc is between 30 degrees and 50 degrees.

19. The water gun of claim 13 wherein the angle formed by said first arc is between 30 degrees and 50 degrees and the angle formed by said second arc is between 30 degrees and 50 degrees.

20. The water gun of claim 11 wherein said male protrusion collar is located on said tank and said female receiving collar is located on said housing.

* * * * *